United States Patent [19]

Krajicek

[11] Patent Number: 4,852,210

[45] Date of Patent: Aug. 1, 1989

[54] WET MOP WITH INTERCHANGEABLE SCRUBBING PAD AND CLOTH WIPE

[76] Inventor: Stephen W. Krajicek, One Lakeside Plaza, Ste. 800, Lake Charles, La. 70601

[21] Appl. No.: 298,778

[22] Filed: Jan. 17, 1989

Related U.S. Application Data

[63] Continuation of Ser. No. 152,480, Feb. 5, 1988, abandoned, which is a continuation-in-part of Ser. No. 85,800, Aug. 17, 1987, abandoned.

[51] Int. Cl.[4] ..... A47L 13/16

[52] U.S. Cl. ..... 15/228; 15/144 A; 15/147 R; 15/231; 24/442

[58] Field of Search ..... 15/228, 144 A, 147 R, 15/147 A, 148, 210 R, 229.2, 229.6, 230.17, 231, 244.3; 24/306, 442–445, 449

[56] References Cited

U.S. PATENT DOCUMENTS

| | | | |
|---|---|---|---|
| 1,045,368 | 11/1912 | Bourne . | |
| 2,611,147 | 9/1952 | Kampouris | 15/147 R |
| 3,012,264 | 12/1961 | Nash | 15/144 A |
| 3,034,165 | 5/1962 | Christian | 15/247 |
| 3,099,855 | 8/1963 | Nash | 15/231 |
| 3,260,294 | 7/1966 | Campion | 24/442 X |
| 3,295,155 | 1/1967 | Belsky et al. | 15/228 |
| 3,464,094 | 9/1969 | Mates | 24/443 |
| 3,465,377 | 9/1969 | Thomas | 15/147 |
| 3,527,001 | 9/1970 | Kleemeier | 51/358 |
| 3,703,739 | 11/1972 | Young et al. | 15/230.17 |
| 3,737,938 | 6/1973 | Saltzstein | 15/231 |
| 3,760,450 | 9/1973 | Griffin et al. | 15/144 A |
| 3,778,860 | 12/1973 | Thielen | 15/147 A |
| 3,792,505 | 2/1974 | Saltzstein | 15/231 |
| 3,877,103 | 4/1975 | Nash | 15/147 R |
| 3,996,639 | 12/1976 | Griffin et al. | 15/229.6 |
| 4,353,142 | 10/1982 | Nishiyama | 15/147 A |
| 4,475,262 | 10/1984 | Downer | 15/144 A |
| 4,531,733 | 7/1985 | Hall | 24/449 X |
| 4,580,307 | 4/1986 | Moss | 15/147 R |
| 4,685,167 | 8/1987 | Murray | 15/228 |

FOREIGN PATENT DOCUMENTS

| | | | |
|---|---|---|---|
| 3101794 | 12/1981 | Fed. Rep. of Germany | 24/306 |
| 798408 | 5/1936 | France | 15/228 |
| 134747 | 3/1952 | Sweden | 15/228 |
| 510675 | 8/1939 | United Kingdom . | |
| 600761 | 4/1948 | United Kingdom | 15/147 R |

*Primary Examiner*—Harvey C. Hornsby
*Assistant Examiner*—Stephen F. Gerrity
*Attorney, Agent, or Firm*—William David Kiesel; Robert C. Tucker; Timothy J. Monahan

[57] ABSTRACT

A wet mop for use with an interchangeable scrubbing pad and cloth wipe is provided, comprising a flat rigid plate, an elongated handle pivotally connected to the plate, a deformable cushion attached to the bottom of the plate and a plurality of pad grippers countersunk within the foam pad and having bristles which extend downward. A porous scrubbing pad can be attached to the bottom of the foam pad by engaging the bristles. Alternatively, instead of the scrubbing pad a terry cloth wipe can be fitted over the foam cushion and fitted around the plate. An elastic band around the perimeter of the wipe secures it in place.

4 Claims, 3 Drawing Sheets

WET MOP WITH INTERCHANGEABLE SCRUBBING PAD AND CLOTH WIPE

RELATED APPLICATIONS

This is a continuation of co-pending application Ser. No. 07/152,480 filed on Feb. 5, 1988, now abandoned, which is a continuation-in-part application of U.S. patent application Ser. No. 07/085,800 filed by Stephen W. Krajicek on Aug. 17, 1987 (now abandoned), specific mention being made herein to obtain the benefit of its earlier filing date.

BACKGROUND OF THE INVENTION

1. Field of the Invention

This invention relates generally to mops and more specifically to wet mops which can accommodate an interchangeable scrubbing pad and cloth wipe.

2. Prior Art

It is desirable when damp mopping floors or applying a floor coating, to have a mop head with a deformable cushion covered by a cloth wipe. There are a variety of prior art mops using the aforementioned combination and many ways have been employed to secure the wipe to the head.

However, the features which are desirable when damp mopping, a deformable, smooth surface, are not beneficial for scouring or scrubbing a floor. For the latter purpose, a stiff, abrasive pad is required. Additionally, it is helpful if the scrubbing pad is porous to absorb the cleaning solutions being applied to the floor. It can be seen that substituting a scrubbing pad for a deformable cushion will not provide the same performance when a cloth wipe is used.

Another shortcoming of the prior art mops is that changing cloth wipes is inconvenient and often requires that the mop be laid down so that both hands of the mopper are free to engage in the operation. Some mops have a sponge head with an abrasive scrubbing strip attached to the side of the mop head. The scrubbing strip is of limited utility because the force generated through the handle is employed inefficiently when the mop is turned on its side. Also, the small surface of area of the strip limits its effectiveness.

SUMMARY OF THE INVENTION

Therefore, it is an object of this invention to provide a mop that is adaptable for damp mopping as well as scrubbing floors.

It is another object of the invention to provide a mop having a deformable, cushioned head covered with a cloth wipe.

It is another object of the invention to provide a mop which can accommodate an abrasive scrubbing pad.

It is still another object of the invention to provide a mop with convenient interchangeability of cleaning media.

A further object of the invention is to provide a scrubbing pad engaging means which does not interfere with the use of cloth wipes.

Other objects and advantages of this invention shall become apparent from the ensuing description of the invention.

Accordingly, a wet mop for use with an interchangeable scrubbing pad and cloth wipe is provided, comprising a flat rigid plate, an elongated handle pivotally connected to the plate, a deformable cushion attached to a bottom of the plate and a pad gripper having a foundation connected to said plate and countersunk with relation to said cushion, and a means for engaging the scrubbing pad.

PREFERRED EMBODIMENT OF THE INVENTION

Without limiting the scope of this invention, the preferred embodiment of the invention will be described.

Figure 1:
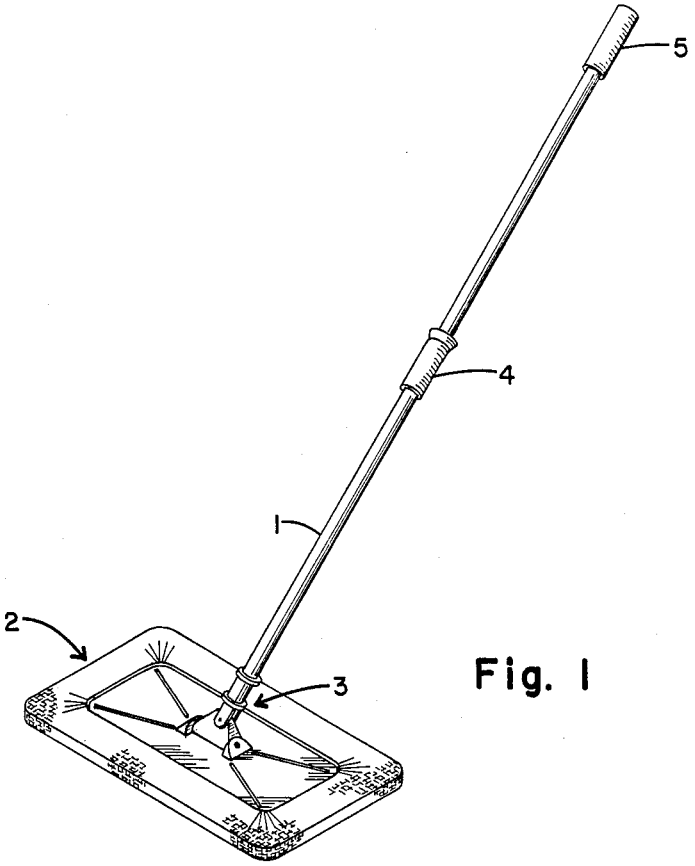
FIG. 1 is a perspective view of the mop.
Figure 2:
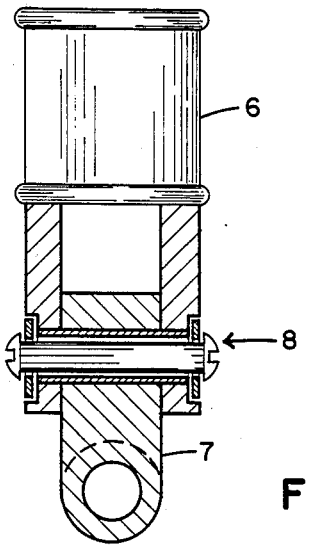
FIG. 2 is a cross section of the upper portion of the universal joint.
Figure 3:
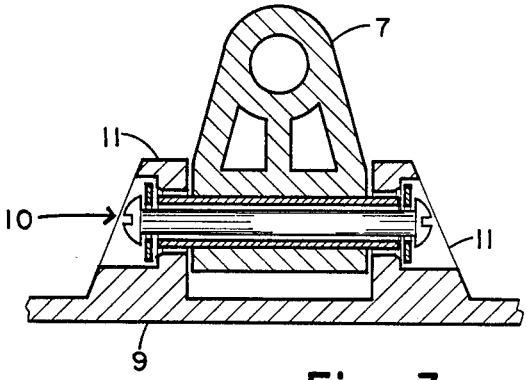
FIG. 3 is a cross section of the lower portion of the universal joint.
Figure 4:
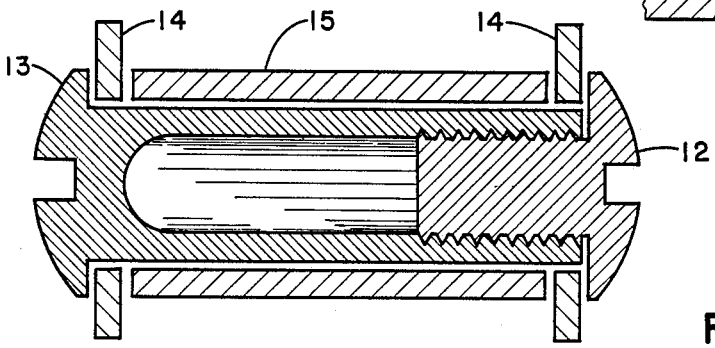
FIG. 4 is an enlarged cross section of the joint pin.

Referring to FIG. 1, the wet mop generally comprises handle 1 which is pivotally connected head 2 by universal joint 3. The basic universal joint is known in the art and is disclosed in Thielen, U.S. Pat. No. 3,778,860. FIGS. 2–4 are detailed drawings of the preferred embodiment of the universal joint including modifications made by applicant. FIG. 2 shows sleeve 6 pivotally connected to swivel 7 by joint pin 8. The remainder of universal joint 3 is shown in FIG. 3. The lower portion of swivel 7 is pivotally connected to plate 9 by joint pin 10 through shoulders 11. An enlarged view of joint pins 8 and 10 is shown in FIG. 4. The joint pin comprises male connector 12, female connector 13, washers 14 and tubing 15. The tubing can be made of Tygon brand tubing or other flexible tubing. The tubing provides increased friction at the connection points.

It can be seen that handle 1 can pivot along two axes thereby allowing force to be applied to mop head 2 from any direction. Because the wet mop offers resistance to movement as a result of the friction between the surface being cleaned and mop head 2, and because the relative position of mop head 2 is controlled by the rotation of handle 1, it is preferred that the handle diameter be enlarged. The enlarged handles, shown as handgrips 4 and 5 in FIG. 1, provide a greater mechanical advantage when applying rotational force to position mop head 2. The second handgrip, handgrip 4 is positioned about $\frac{1}{3}$ of the way down handle 1.

Figure 5:
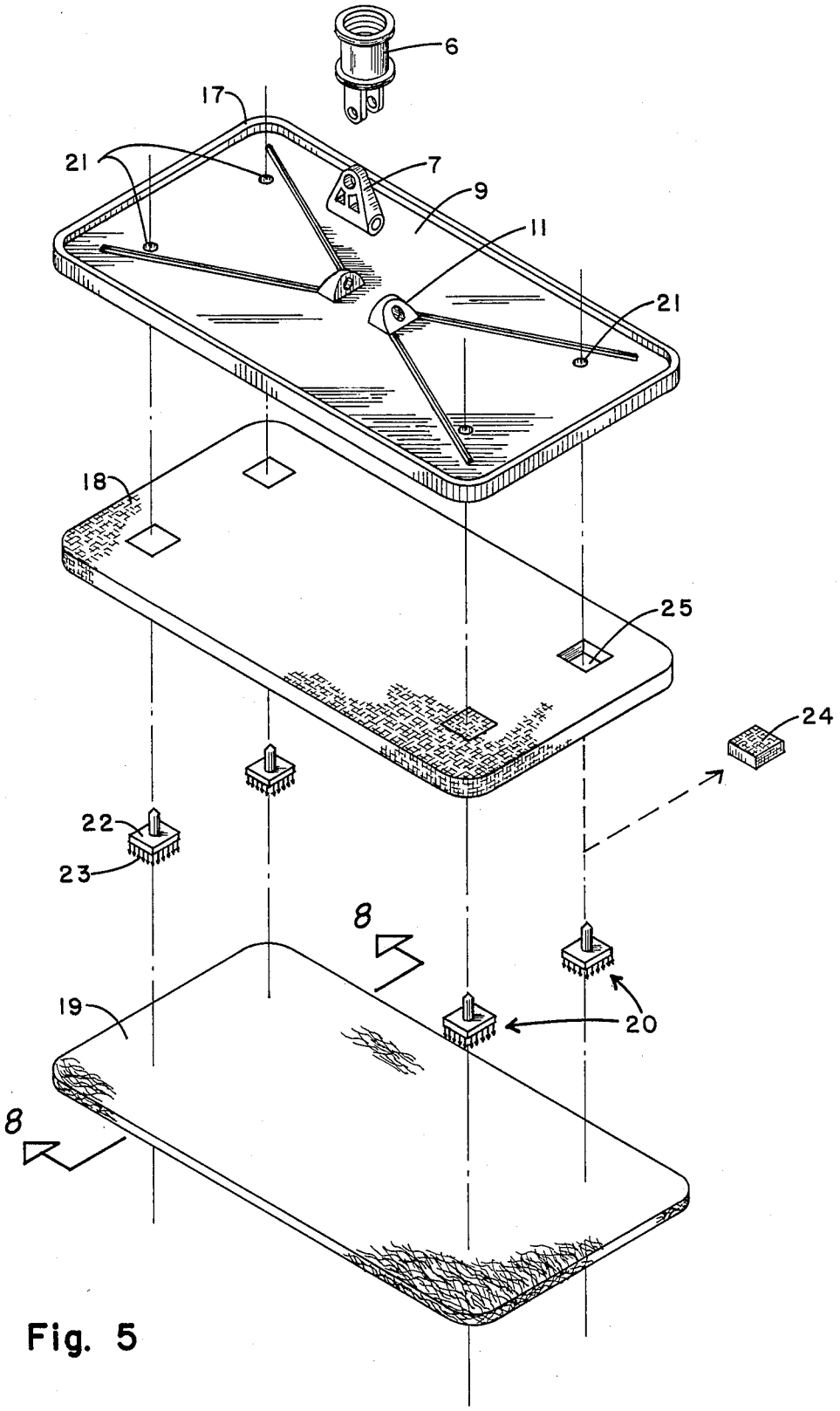
FIG. 5 is an exploded view of the mop head with the scrubbing pad.

An exploded view of the invention is shown in FIG. 5. Plate 9 is a flat, rigid structure having shoulders 11 integrally molded on the top side. Lip 17 on the top of plate 9 provides reinforcement. The bottom of plate 9 is smooth to accommodate cushion 18. In the preferred embodiment, cushion 18 is a deformable, fine, closed cell foam having a water absorption of 6% or less by volume and a compression strength between 1.5 to 3.5 pounds per square inch to produce no more than a 25% deflection of the foam during normal use. Those will skill in the art may adapt other materials as a cushion. The important features are that the material be deformable so that when covered with cloth wipe 26 as in FIGS. 6 and 7, the surface will contour to the surface being cleaned and prevent abrasion of cloth wipe 26.

The cushion 18 must also serve as a backing for scrubbing pad 19 which requires that cushion 18 be firm enough to transfer force from plate 9 to scrubbing pad 19.

Scrubbing pad 19 is held in place by pad grippers 20. Scrubbing pad 19 is made of a durable, stiff material capable of scouring floors and the like. In addition to good abrasion resistance, it is preferred that scrubbing pad 19 be porous so that it can be easily wetted with a cleaning solution. Those with skill in the art may select a scrubbing pad from a wide range of suitable material.

Figure 7:
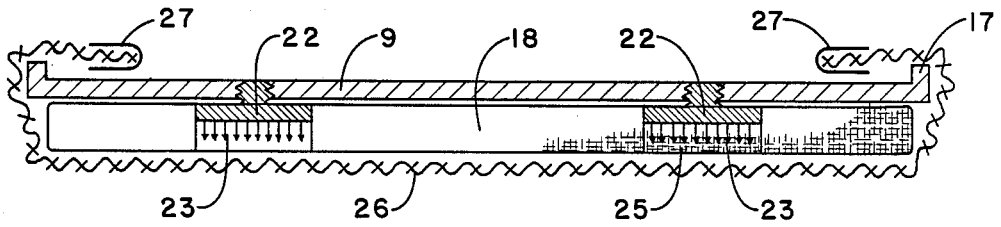
FIG. 7 is a cross section of the mop head taken along line 7—7 in FIG. 6.
Figure 8:
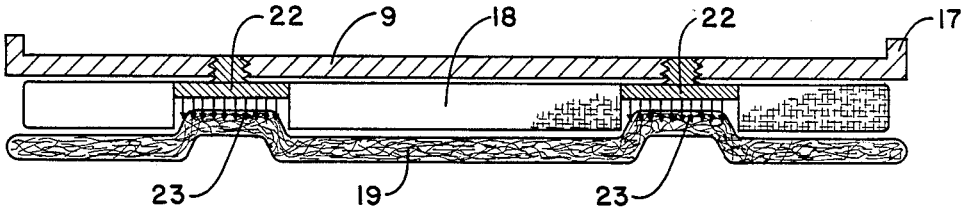
FIG. 8 is a cross section of the mop head taken along line 8—8 in FIG. 5.

Holes 21 have been drilled in plate 9 to accommodate foundation 22 of pad gripper 20. In the preferred embodiment, foundation 22 comprises a shank with a flat base. As seen in FIG. 8, foundation 22 is countersunk in relation to cushion 18. This prevents pad grippers 20 from interfering with the cleaning action of the mop when, as in FIG. 7, scrubbing pad 19 has been replaced with cloth wipe 26. Referring to FIG. 5, pad grippers 20 have downwardly extending bristles 23 which are means to engage scrubbing pad 19. In the preferred embodiment, bristles 23 do not extend beyond the bottom of cushion 18. FIG. 8 shows how scrubbing pad 19 can easily be pushed up to engage bristles 23. The shape of bristles 23 need not be that of an arrowhead and can have, for example, nodules at the tip or a hook shape. Many types of Velcro brand products will suffice to engage the pores in scrubbing pad 19. It may also be possible to use means other than bristles to grip scrubbing pad 19. For example a snap may be mounted on foundation 22 in which case a mate of the snap could be secured to a side of scrubbing pad 19. However, because it is envisioned that the scrubbing pads will be disposable, it is desirable that they be manufactured as inexpensively as possible, i.e. without fastener secured thereto.

For marketing purposes, it may be desirable to distribute the scrubbing pad and pad grippers as a separate conversion kit. As shown in FIG. 5, cushion 18 would have inserts 24 which could be removed to expose recesses 25. The adhesive backing used to secure cushion 18 to plate 9 could be left on inserts 24 to permit their removal. A small section of the perimeter of insert 24 remains connected to cushion 18 until conversion is desired.

Figure 6:
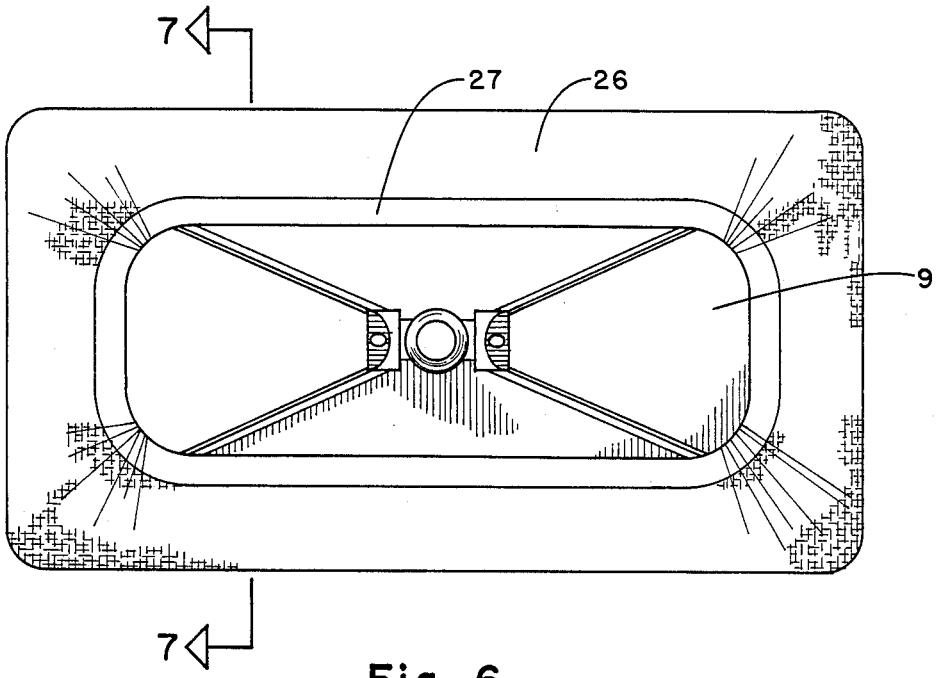
FIG. 6 is a top view of the mop head with the cloth wipe.

Instead of scrubber pad 19, mop head 2 can readily accommodate cloth wipe 26. Various prior art means to attach a cloth wipe to a mop head may be employed provided that they do not interfere with the method disclosed herein of securing a scrubbing pad to a mop head. The preferred method is shown in FIGS. 6 and 7. FIG. 6 shows how cloth wipe 26 is wrapped over the perimeter of plate 9. Elastic band 27 around the perimeter of cloth wipe 26 draws cloth wipe 26 taut. The term "cloth wipe" is intended to encompass any material, whether natural or man-made, which is absorbant and may be wrapped around the head of a mop. Additional preferred features are that the material be machine washable, relatively inexpensive and durable. It is believed that terry cloth is well suited for the wipe.

FIG. 7 shows a cut away view of mop head 2 with cloth wipe 26 in place. It can be seen that foundation 22 is countersunk and will not interfere with cloth wipe 26. It is preferred that the scrubbing pad engaging means does not extend beyond the bottom of cushion 19. However, if the scrubbing pad engaging means is made of a flexible material, such as bristles 23, it is believed that contact with cloth wipe 26 will not interfere with damp mopping or the like.

There are, of course, other alternate embodiments and features, not specifically shown, which are intended to be included within the scope of this invention as defined by the following claims.

What I claim is:

1. A wet mop with a removable scrubbing pad to accommodate a cloth wipe, comprising:

(a) a flat, rigid plate;

(b) an elongated handle;

(c) means to pivotally connect an end of said handle to a top side of said plate;

(d) a planar deformable cushion of a size similar to that of said plate having a top side attached to a bottom side of said plate, said cushion further having a bottom side and a plurality of recesses extending through a thickness of said cushion;

(e) pad grippers positioned in said recesses, each of said pad grippers having a foundation secured to said plate and a plurality of downwardly extending bristles within said recesses such that said bristles do not extend beyond a bottom surface of said cushion; and (f) a substantially planar, porous scrubbing pad detachably secured to said bottom side of said cushion, wherein areas of said scrubbing pad overlaying said recesses are sunken into said recesses and said bristles penetrate into and engage said scrubbing pad.

2. A wet mop according to claim 1, wherein said recesses in said cushion are positioned interior to a perimeter of said cushion.

3. A wet mop according to claim 1, wherein said means to pivotally connect said handle to said plate comprises: first and second forks extending from said end of said handle, each fork having a hole, said holes being axially aligned, a swivel positioned between said forks, said swivel having a bore axially aligned with said holes, a flexible tube extending through said hole in said first fork, said bore in said swivel and said hole in said second fork, said tube having an outside diameter substantially equal to an inside diameter of said holes and said bore, first and second washers axially aligned with said holes and abutting a first and second end of said tubing respectively, a female connecter having a shank extending through said first washer and said tube, a male connector having a shank extending through said second washer, and threaded into a core of said shank of said female connector, and said female and male connectors having heads securing said first and second washers respectively such that screwing said connectors together compresses said tube.

4. A wet mop according to claim 3, wherein said recesses in said cushion are positioned interior to a perimeter of said cushion.

* * * * *